US006783450B1

(12) United States Patent
Meyer

(10) Patent No.: US 6,783,450 B1
(45) Date of Patent: Aug. 31, 2004

(54) FOR GRINDING WHEEL FOR GRINDING PROCESS

(75) Inventor: Hans-Robert Meyer, Hollernstrasse (DE)

(73) Assignee: Ernst Winter & Sohn Diamantwerkzeuge GmbH & Co., Norderstedt (DE)

( * ) Notice: Subject to any disclaimer, the term of this patent is extended or adjusted under 35 U.S.C. 154(b) by 548 days.

(21) Appl. No.: 08/845,673

(22) Filed: Apr. 25, 1997

Related U.S. Application Data

(62) Division of application No. 08/254,346, filed on Jun. 6, 1994, now Pat. No. 5,645,476, which is a continuation of application No. 07/659,863, filed on Feb. 25, 1991, now abandoned.

(30) Foreign Application Priority Data

Mar. 3, 1990 (DE) ..... 400 66 606

(51) Int. Cl.[7] ..... B24D 5/10
(52) U.S. Cl. ..... 451/548
(58) Field of Search ..... 451/544, 541, 451/546, 548; 51/297, 298

(56) References Cited

U.S. PATENT DOCUMENTS

| | | | |
|---|---|---|---|
| 2,475,517 A | 7/1949 | Ries et al. | 451/541 |
| 3,290,834 A | 12/1966 | Lindblad | 451/541 |
| 4,037,367 A | 7/1977 | Kruse | 451/548 |

FOREIGN PATENT DOCUMENTS

| | | |
|---|---|---|
| DE | 2411859 | 3/1974 |
| DE | 3530974.1-14 | 8/1985 |
| DE | 3537331.8 | 10/1985 |
| DE | 3537331 | 4/1987 |

*Primary Examiner*—Robert A. Rose
(74) *Attorney, Agent, or Firm*—Mary E. Porter

(57) ABSTRACT

The invention relates to an improved grinding wheel for grinding eye glass edges. The grinding wheel comprises a base member and an abrasive coating of diamond and metal. The base member 3 consists substantially of plastic material and an annular member 2 of metallic material is provided between the base member 3 and the coating 1. The metallic material of the annular member 2 has a strength withstanding the forces occuring in sintering the coating to the annular member.

10 Claims, 1 Drawing Sheet

FOR GRINDING WHEEL FOR GRINDING PROCESS

This application is a divisional application of U.S. Pat. No. 5,645,476, issued Jul. 8, 1997, which is a division of U.S. patent application Ser. No. 07/659,863 filed Feb. 25, 1991, now abandoned.

BACKGROUND OF THE INVENTION

The present invention relates to a grinding wheel for grinding edges of eye glasses, comprising a base member and an abrasive coating made of diamond and metal. The invention particularly relates to peripheral wheels, in particular including a peripheral profile.

Due to the manufacturing process the abrasive coating of diamond and metal has a relatively small thickness in the range of about 3 mm or less, wherein the diamond particles have a size of about 250 $\mu$m or less.

Grinding eye glass edges encounter substantial problems. The eye glass material is very brittle and is likely to break when very small irregularities are encountered. Furthermore the material is rather thin with little strength against lateral forces. Unbalances of the grinding wheel result in substantial waste.

Still further, small machines having thin spindles are used to work eye glasses. Therefore, the weight of the grinding disk is substantial for those machines.

Peripheral grinding disks are known, comprising a base member and a grinding coating, wherein the base member is provided with a central bore to be mounted on a spindle. This is true for all disk types including those having particular bore profiles.

In prior art grinding disks comprising an abrasive coating of diamond and plastic material, base members made of a plastic material including metallic fillers as well as natural fillers and base members of aluminum or steel are known. Grinding disks of this type do not lend themselvses to the application above referred to as the resin in the abrasive coating does not provide a binding of sufficient stability suitable for finely grinding an extremely brittle and thin material.

Furthermore, known base members, in particular metallic base members have a substantial weight. Admittedly aluminum has a smaller weight than steel, but the bonding between the abrasive coating and the metallic binder and aluminum encounters problems. The bonding can be satisfying, but does not provide an optimum solution because among other problems the expenditure to make such a bonding is substantial.

According to still further prior art the metal of abrasive coatings made of diamond and metal may be bronze of different types such as pure bronze, silver bronze, cobalt bronze and so on, galvanically deposited nickel or even hard metal or hard alloys.

This results in an excellent abrasive coating of substantial wear resistance even under the influence of pressure and heat. However, the base member of up to 95% of all grinding disks consists of steel or bronze because of the joining operation. The resulting disk is heavy, has a high accuracy of symmetry but does not have dampening abilities and fully transmits any unbalances.

Using a base member of resin including metallic fillers, the operation of joining the abrasive coating thereon in particular by a pressing, cementing or shrinking process results in a bonding which is not satisfying with respect to the symmetry i.e. the peripheral accuracy of the disk so that the disk is subjected to vibrations. Furthermore the bad heat conductivity of the resin leads to heating problems, in particular when the coating is worn down to a thickness of some tenths millimeters while the heat generated in grinding must be carried away. The abrasive coating may be not applied by sintering as the base member does not have a suitable strength to withstand the pressure and heat of the sintering process. This is the reason that base members of steel and bronze are primarily used for abrasive coatings of diamond and metal.

Still further, base members carrying abrasive coatings tend to deformations under the application of the grinding pressure and heat which are detrimental to creating fine profiles.

Steel has to be pretreated, for example galvanized which increases costs. The pretreatment is necessary for bonding the bronze to the steel.

Summarizing the prior art disks are not suitable for grinding eye glass edges since they result in high wast rates in transmitting unbalances, stiff structure, dampening inability or even unsymmetrical design.

The aim of the present invention is to provide an improved grinding wheel of the type referred to above exhibiting high precision grinding characteristics with respect to accuracy in particular in working an extremely brittle and thin material under economical conditions.

SUMMARY OF THE INVENTION

According to the present invention the base member of grinding disks including an abrasive coating of diamond and metal substantially consists of a plastic material, wherein an annular member of a metallic material is provided between said base member and said abrasive coating.

According to the invention the disk is principally made up of three layers. Such a formation may be known per se, but then there is a core or base member of metal, in particular aluminum to which a steel or bronze ring is provided which supports the abrasive coating resulting in a relatively stiff and hard structure.

The dampening ability of those triple layer disks is little and the bonding encounters problems as coating the abrasive material on the steel ring necessitates an expensive pretreatment thereof. Furthermore in sintering the abrasive coating on a bronze ring a breaking or deformation of the bronze ring is likely under the temperature and pressure of sintering.

The disks of the known type are heavy which is detrimental to the small and light machines used for grinding eye glass edges. The little dampening of unbalances and lacking compatability to the machines used result in additional loads to machines, disks and glasses.

The plastic material of the base member in combination with the intermediate ring of metallic material and the abrasive coating of diamond and metal results in a particularly good characteristic with respect to vibration, dampening and rigidity which makes a gentle abrasive operation possible. To support the abrasive coating on a ring of metallic material allows symmetry and accuracy and further facilitates carrying away the heat in the disk. This is a substantial advantage for a plastic core even when containing filling materials. The ring of metallic material further allows to improve the bonding, in particular the peripheral strength and wear resistance of the disk materials which all are necessary to provide a precision tool.

Bonding, vibrational parameters and symmetrical accuracy including heat removal is greatly improved by using the combination of a plastic base member and a metallic intermediate ring including an abrasive coating of diamond and metal, bronze, galvanic nickel or hard metal.

A particular advantage of the present invention should be seen in the strength of the metallic material of the ring which is easily subjected to the forces occuring in sintering. This provides for a particularly useful substrate.

It is further preferred that the metallic material of the annular member is more heat resistant than the abrasive coating.

The heat removal, bonding and dampening is further improved by a preferred embodiment in which the annular member is made of copper. However, the ring can be made of bronze, in particular tempered bronze. The combination still includes rings of aluminum and steel. The bonding makes certain problems but otherwise the advantages indicated prevail. However, the latter embodiment is less economical, and flexibility i.e. dampening of the disk is reduced.

Preferrably the thickness of the ring is up to 10% of the radius of the disk. This provides a support strong enough for sintering the abrasive coating thereon. This is preferred in combination with a copper ring.

Preferrably, even with smaller disks the thickness of the ring is in the range of 3 to 10 mm resulting in a combination of the abrasive coating and metallic ring.

According to a further aspect of the present invention the base member is made of a plastic resin, in particular including filling materials. With respect to heat resistivity and mechanical strenth, suitable thermoplastic and duroplastic materials are used. For a duroplastic material a phenol resin (for example "bakelit" registered trademark) is preferred. Other phenol formaldehyde condensation products can be used as well as other thermoplastic and duroplastic materials, but the preferred embodiment results in excellent characteristics as to strength, workability and elasticity by incorporating filling materials which are mostly fibre materials.

Preferrably filling materials such as carbon fibres or glass fibres including asbesto fibres and/or metals are used.

According to the present invention the metal in the abrasive coating preferrably consists of bronze, galvanically deposited nickel, hard metal or other metal alloys. Bronze is preferred as it is economically and easily applied to a metallic ring. A steel ring is less preferred as it needs an expensive pretreatment when bronze is applied.

Excellent bondings result between bronze as a binder of the abrasive coating and copper of the ring. Copper is preferred because of its high heat conductivity.

The duroplastic materials of the base member above referred to have certain advantages, in particular in combination with a copper intermediate ring between the abrasive coating and the plastic base member.

A preferred embodiment of the present invention comprises a grinding disk having a sintered abrasive coating of diamond particles in a range of 3 to 250 $\mu$m and a metal, in particular a copper layer defining an annular support member having a high heat conductivity with reference to the base member. The disk has a relatively light weight, but is sufficiently rigid with respect to stress conditions.

The module made up of the metallic ring and the abrasive coating, particularly bonded by a sintering process can be bonded to the base member in a variety of ways. According to a particularly useful embodiment the annular module is bonded by a shrinking process. This allows a dense contact to the peripheral face of the base member facilitating machining. The shrinking process allows to award a high bonding force to the disk shaped base member to obtain a tool of high precision.

According to another useful embodiment, the annular module is cemented to the base member with the cementing layer small enough to exclude elasticities. It is remembered that the invention relates to a peripheral disk.

The present invention provides a novel and unique grinding tool for machining glass. The plastic material base member can be particularly precisely machined. The material is higher resistant against external parameters than metal, i.e. less sensitive to expansion due to heat. This feature would be worsened when metal would be used to an higher extent.

For glass grinding, a dampening support member of little mass is substantial.

The plastic material itself is of light weight and has dampening characteristics. Any unbalance can be cushioned and the material to be machined is not wasted by breaking.

Heat removal is improved by a metallic support of the abrasive layer. Then the abrasive coating can be worn down until the last relatively expensive diamond particles are worn off.

A heat conducting copper support member provides for a high heat conductivity and for a safe bonding. Here a direct bonding of the metallic support on the dampening plastic base member is used.

Inserting a metallic layer results in a further advantage since the base member of plastic material must show particular characteristics with respect to heat transfer which is not easy to accomplish when a metallic coating is not applied.

According to a further embodiment the periphery of the plastic base member is preferred to have an increased heat conductivity adjacent the abrasive coating including the metallic ring.

To improve the heat removal the plastic base member is peripherally provided with heat conducting components, in particular metals which extend to a range of at most 20% of its radius.

The sublayer of copper is a particular advantage in a preferred embodiment as the abrasive coating may be used until worn off while maintaining a high heat removal.

BRIEF DESCRIPTION OF THE DRAWINGS

Other advantages and features of the invention will appear from the following description of a non-limiting embodiment with reference to the Figures which show.

The grinding disk is a cylindrical or peripherally profiled disk which is used for grinding eye glass edges. An abrasive coating 1 has a thickness of about 3 mm and consists of diamond particles as abrasive elements which are held in a binder, preferrably bronze. The abrasive layer is sintered on a copper ring 2 which is defined by a metallic annular support member of high heat conductivity and suitable stability for supporting the abrasive coating.

The copper ring 2 is provided on a base member 3 consisting of plastic resin, in particular a phenol resin as above referred to. To the phenol resin filling material not shown is added which consists of glass fibres or carbon fibres.

It is further considered to provide metal particles, for example aluminum particles, preferrably adjacent the bonding between the ring 2 and the base member 3 to improve heat transfer.

The ring 2 can be fixed to the base member 3 by an adhesive component or by a shrinking process.

The base member has a central bore 4 for mounting on a shaft of a grinding machine.

Figure 1:
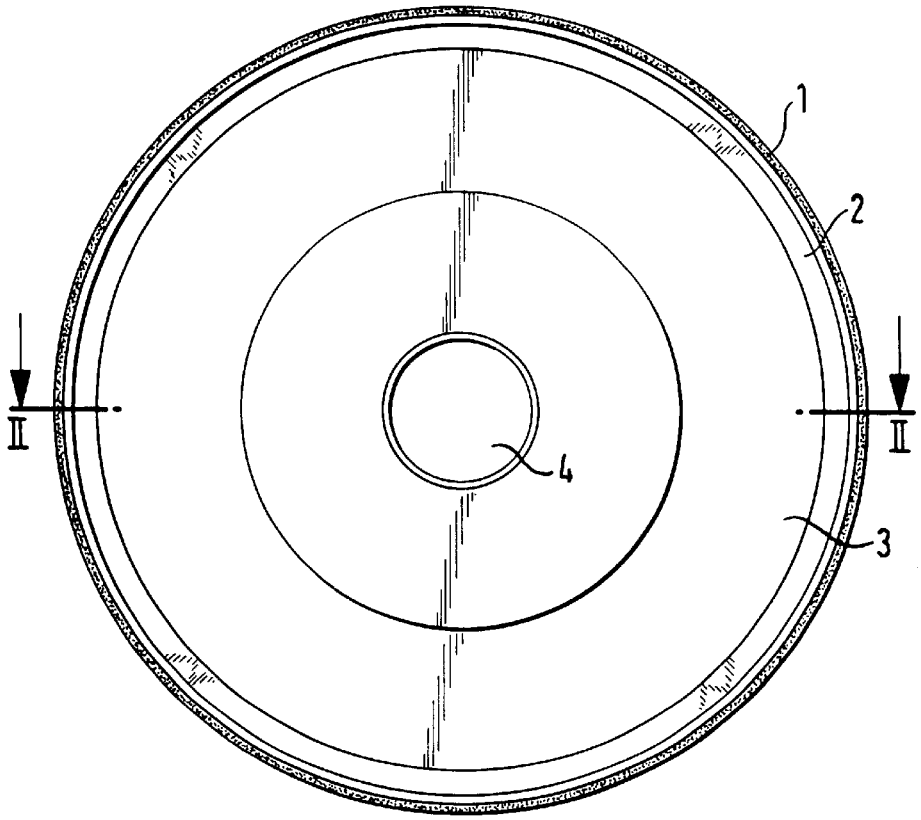
FIG. 1 a side view of a grinding wheel in an enlarged scale in particular for use with edge grinding of eye glasses, FIG. 2 a section through line II—II in FIG. 1.
Figure 2:
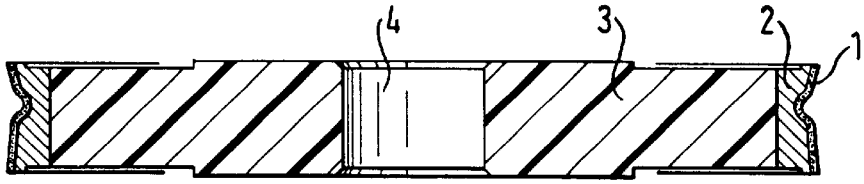

The peripheral profile as shown in FIG. 2 is suitable to grind a projection along the edge of an eye glass, while cylindrical non-profiled disks are used for pregrinding.

What is claimed is:

1. A precision grinding disc for grinding edges of eye glasses, the grinding disc comprising:

a base member comprising a plastic disc having an outer circumference; and;

an annular module made of a continuous, solid metallic ring having an inner circumference and a peripheral face, and a discrete abrasive coating comprising abrasive particles and metal particles, the abrasive coating being sintered to the peripheral face of the metal ring and the inner circumference being free of the abrasive coating, wherein the inner circumference of the annular module is attached concentrically around the base member onto the outer circumference of the plastic disc;

and whereby the abrasive coating is isolated from the plastic disc.

2. The grinding disc of claim 1, wherein the metallic ring of the annular module is more heat resistant than the abrasive coating.

3. The grinding disc of claim 1, wherein the grinding disk has a radial thickness and the annular module has a maximum radial thickness of 10 percent of the radial thickness of the grinding disc.

4. The grinding disc of claim 3, wherein the radial thickness of the annular module is 3 to 10 mm.

5. The grinding disc of claim 1, wherein the base member comprises filling materials.

6. The grinding disc of claim 5, wherein the filling materials are fiber materials.

7. The grinding disc of claim 6, wherein the fiber materials are selected from the group consisting of carbon fibers, glass fibers, asbestos fibers, and combinations thereof.

8. The grinding disc of claim 3, further comprising heat conducting materials within a periphery of the plastic disc, the heat conducting materials extending from the outer circumference of the plastic disc over a maximum range of 20 percent of the radial thickness of the grinding disc.

9. The grinding disc of claim 1, wherein the abrasive coating has a maximum radial thickness of 3 mm.

10. A grinding disc for grinding edges of eye glasses, comprising:

a disc-shaped circular base member of plastic material having an outer circumference;

an annular member of continuous, solid metallic material, having a ring shape, a selected thickness, an inner circumference directly attached to the outer circumference of the base member and a peripheral face, the annular member having sufficient mechanical strength to maintain symmetrical accuracy under pressure at a metal brazing temperature; and a discrete abrasive coating, comprising diamond abrasive bonded in a metal bond, sintered onto the peripheral face of said annular member prior to bonding of the annular member to the base member, wherein the inner circumference of the annular member consists of metallic material, is free of the abrasive coating and is shaped concentric placement upon the outer circumference of the base member.

* * * * *